United States Patent [19]

Hegazi

[11] Patent Number: 4,590,729

[45] Date of Patent: May 27, 1986

[54] MODULAR CONSTRUCTION SYSTEM FOR THE ERECTION OF BUILDINGS

[76] Inventor: Wafaa H. Hegazi, 50 Kasr El Nil St. (P.O. Box 1419), Cairo, Egypt

[21] Appl. No.: 606,391

[22] Filed: May 2, 1984

[30] Foreign Application Priority Data

Nov. 9, 1983 [CH] Switzerland ..... 6028/83

[51] Int. Cl.[4] ..... E04B 2/72

[52] U.S. Cl. ..... 52/437; 52/743; 52/607

[58] Field of Search ..... 52/606, 607, 284, 286, 52/259, 250, 251, 477, 204, 434, 437–442, 743, 744

[56] References Cited

U.S. PATENT DOCUMENTS

| | | | |
|---|---|---|---|
| 1,970,414 | 8/1934 | Brown | 52/477 |
| 2,008,370 | 7/1935 | Schwalbe | 52/606 |
| 2,029,586 | 2/1936 | Rendoff | 52/607 |
| 2,260,425 | 10/1941 | Widmayer | 52/440 |
| 3,076,293 | 2/1963 | Baudoux | 52/204 |

FOREIGN PATENT DOCUMENTS

| | | | |
|---|---|---|---|
| 24730 | 12/1936 | Australia | 52/606 |
| 170581 | 12/1950 | Austria | 52/259 |
| 429757 | 2/1948 | Italy | 52/602 |
| 442677 | 1/1968 | Switzerland | 52/259 |
| 591067 | 8/1947 | United Kingdom | 52/286 |
| 796430 | 6/1958 | United Kingdom | 52/434 |

*Primary Examiner*—James L. Ridgill, Jr.
*Attorney, Agent, or Firm*—Werner W. Kleeman

[57] ABSTRACT

Hollow-core construction blocks are superposed without intervening mortar. The hollow-core construction blocks are provided with vertical, longitudinally spaced cylindrical apertures. Vertical slots having the same spaced relationship are interposed between the vertical apertures. Both the vertical apertures and the vertical slots open at one side of the block in a longitudinal channel having an at least approximately semi-circular cross-section. These building components permit forming arbitrarily high walls by the "dry", i.e. without mortar, superposition of the construction blocks and pouring concrete into the cylindrical vertical apertures of an upper row of blocks. The concrete flows downward, perhaps with the aid of a vibrator, and spreads out in lateral direction through the longitudinal channels. The vertical slots provide a means of escape for the displaced air.

19 Claims, 5 Drawing Figures

MODULAR CONSTRUCTION SYSTEM FOR THE ERECTION OF BUILDINGS

BACKGROUND OF THE INVENTION

The present invention concerns a modular construction system for the erection of buildings in which hollow-core construction blocks are superposed upon one another without intervening mortar and are intended to be filled with concrete.

For the erection of economical buildings, especially residential buildings, so-called hollow-core construction blocks are often employed instead of solid brick or hollow-core concrete construction blocks. The hollow-core blocks of the invention are layed in layers without mortar joints and are then bonded by pouring them full of concrete.

This method of construction is often problematical, especially with respect to filling the concrete into the openings provided therefor without entrapping air pockets or forming voids. For this reason the erection of a wall usually proceeds in steps in which erection or laying work is interrupted by concrete pouring or filling work. Heretofore known hollow-core construction blocks also seldom permit practical corner joints for abutting walls or the convenient anchorage of an interior partition wall to an exterior wall. Furthermore, the erection of floors or roofs must usually be done in a conventional manner.

SUMMARY OF THE INVENTION

Therefore, with the foregoing in mind it is a primary object of the present invention to provide a new and improved design of a modular construction system for the erection of buildings of the aforementioned type which does not have associated with it the aforementioned drawbacks and shortcomings of the prior art constructions.

Another and more specific object of the present invention aims at providing a new and improved construction of a building system of the previously mentioned type permitting a considerably more rational and more economical erection of buildings while satisfying all requirements of structural stability and resistance.

These and other objects of the invention are fulfilled according to the invention by providing the substantially quadrangular or rectangular hollow-core construction blocks with substantially vertical apertures or through-bores of substantially circular cross section arranged in predetermined spaced relationship in the longitudinal direction of the block. These vertical apertures are proximate to vertical openings or slots analogously spaced. These vertical apertures or through-bores and vertical openings or slots open into a channel formed longitudinally in the block at either its upper or its lower side and having an at least approximately semi-circular cross section.

This configuration of the construction blocks makes it possible to first erect arbitrarily high walls by piling or superposing hollow-core construction blocks according to the invention dry, i.e. without mortar, and only then to pour fluid concrete into the circular vertical apertures of the uppermost layer of the hollow-core construction blocks. The fluid concrete then flows, perhaps under the influence of an auxiliary tool such as a vibrator, both vertically downward and laterally into the longitudinal channels, the vertical slots providing unhindered and complete exhaustion of the displaced air.

When all of the air has been displaced the same vertical slots serve as upward conduits or risers and also fill with concrete. This has the particular advantage of enabling an intimate connection between the narrow ends of adjacent blocks.

It is further advantageous that the vertical apertures and the longitudinal channels form a concrete grill of very high strength. Additionally, the vertical apertures and the longitudinal channels can be exploited to accommodate reinforcing means for the concrete or utility conduits or both before the concrete is poured.

The vertical slots can be formed to have vertical bore portions at both of their ends for the accommodation of positioning or locating pins to assure plumbness in spite of rapidly progressing construction. Such an arrangement of positions or locating pins is also particularly well suited for the anchorage of transverse walls or interior partitions.

This configuration of the vertical slots also provides an optimum means of accurately halving or quartering the blocks.

A further embodiment of the invention permits an advantageous mutual interconnection of the hollow-core construction blocks at their narrow ends by providing four vertical apertures in each construction block in proximate relation with vertical slots at both sides thereof. The slots at each of the narrow ends of the hollow-core construction blocks are formed with one long side open to cooperate with a corresponding such slot in the narrow side of an adjacent hollow-core construction block and form fully surrounded or complete vertical slots.

A further substantial rationalization in the erection of a building with the system of the invention is achieved by providing structural floor members of predetermined width and predetermined free span length for the formation of floor and roof structures. These structural floor members are supported at their narrow ends in the finished building upon the hollow-core construction blocks forming the load-bearing wall of the building or upon special lintel members.

In order to fulfill the most stringent structural requirements, it is advantageous to provide the structural floor members with a U-shaped or channel cross section and to subdivide it into structural fields or bays separated by transverse ribs such that the upper surface of the structural floor member displays a series of open rectangular or channel-shaped cells or basins arranged longitudinally. It is further advantageous to provide the structural floor member with reinforcing means.

It is also advantageous to provide the structural floor members at their exterior edges with reservations or steps which cooperate with corresponding reservations or steps in adjacent structural floor members to form grooves or channels which can be filled with concrete to produce an effective interconnection of the structural floor members with one another and with the support or anchorage.

In completion of the entire modular construction system it is practical to provide floor panel elements for covering the open cells or basins of the structural floor members and to further provide cover panel elements for covering the narrow ends of structural floor members supported on a load-bearing wall or lintel.

It is further practical to make the hollow-core construction blocks and the structural floor members of a structural material having a good insulating value, such as light weight concrete or rigid wood wool, in order to provide a light construction with adequate thermal insulation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
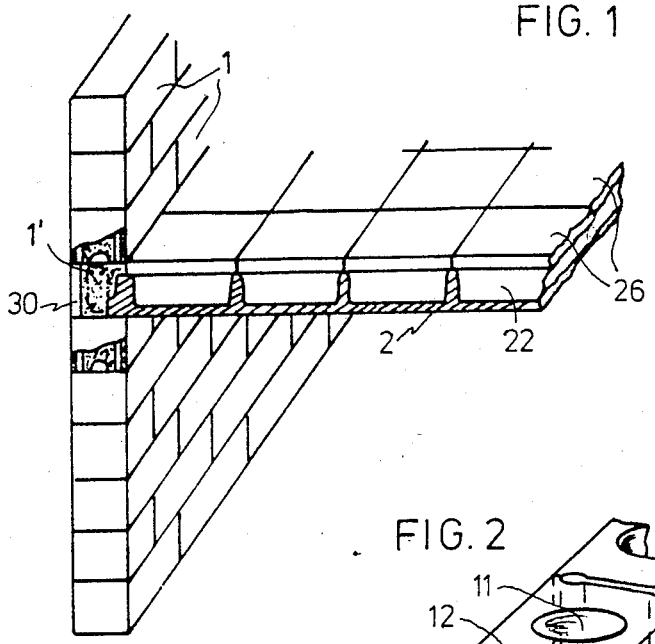
FIG. 1 shows a schematic partial view of a building erected according to the construction system of the present invention.

The modular construction system for the erection of buildings according to the invention as shown in FIG. 1 comprises a plurality of hollow-core construction blocks 1 laid up in the manner of masonry blocks or bricks but without mortar and then filled with a pourable, curable building material like, for example, concrete, as well cellular structural floor members 2 which, in the embodiment of the invention shown, are supported on a special lintel member 1' formed by an intermediate layer in the layered wall erected of such hollow-core construction blocks 1. So-called cover panel elements 30 serve to cover the narrow ends of cellular structural floor members 2 supported on the lintel member 1' and may be formed by concrete panels or similar construction elements. Finally, the cellular structural floor members 2 are covered by suitable floor panel elements 26 made of structural tile material or of a cement product. In the following description, the elements of the system will be explained in more detail.

Figure 2:
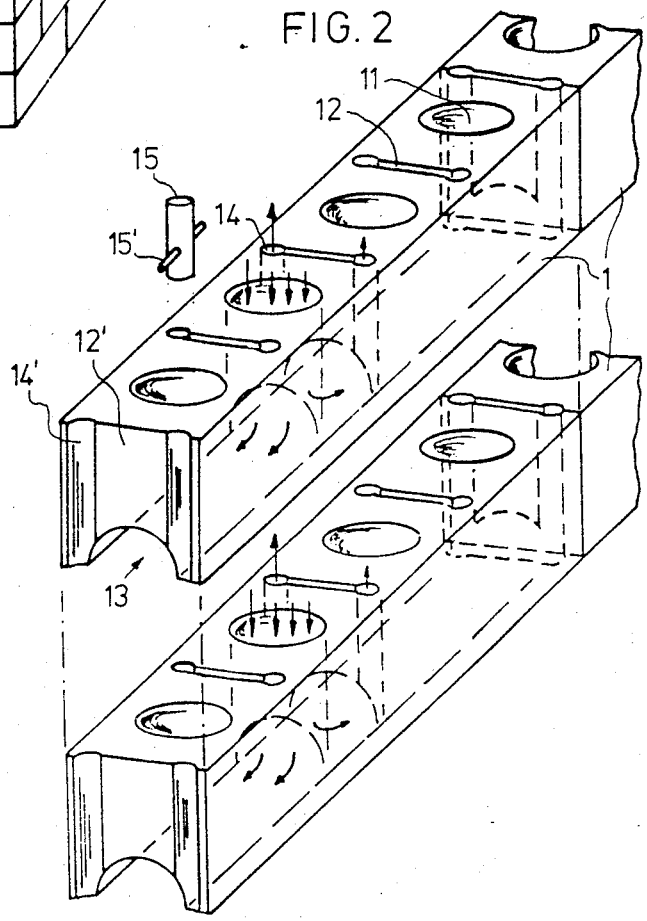
FIG. 2 shows an axonometric representation of several hollow-core construction blocks according to the invention in the process of being layed.

As shown in detail in FIG. 2, substantially quadrangular, for instance rectangular hollow-core construction blocks 1 are provided with substantially vertical apertures or through-bores 11 of circular or round cross-section arranged in predetermined mutual spaced relationship along the length of the block. The substantially vertical cylindrical apertures 11 are also arranged in proximate relationship to substantially vertical openings or slots 12 which are arranged in an analogous mutual spaced relationship along the length of the block 1. The block 1 is provided with a longitudinal channel at either its upper or its lower face having an least approximately half-round or semi-circular cross section. Both the vertical apertures 11 and the vertical slots 12 open into this longitudinal channel 13.

It can also be seen in FIG. 2 that the vertical slots 12 have vertical cylindrical bores 14 formed at both of their ends for the accommodation of positioning or locating pins or dowels 15. It has also proven practical to provide each hollow-core construction block 1 with four such vertical apertures 11 in proximate relationship to vertical slots 12 at each side and to form the vertical slots at both narrow ends of the block to be open at one side and therefore to form substantially one half of a slot to cooperate with a further such half of a slot provided in the narrow end of an adjacent block and thereby form a single, completely enclosed or surrounded substantially vertical slot.

The hollow-core construction blocks 1 are preferably and substantially uniformly made of an easily obtained material such as light weight concrete, cemented wood wool, or the like and preferably have the external dimensions of 25 centimeters by 25 centimeters by 100 centimeters which results in a hollow-core construction block of modular proportions which is easy to handle and universally applicable.

In this relation, the hollow-core construction blocks 1 according to the invention can be accurately modularly subdivided at the regions of the interior vertical slots 12.

As can be seen from FIG. 2, the construction blocks 1 according to the invention can be first erected in layers to form arbitrarily high walls or a predetermined wall structure by stacking or superposing them "dry" i.e. without intervening mortar layers, and then to pour concrete into the circular or round vertical apertures 11 of the uppermost layer of hollow-core construction blocks. The fluid concrete then, optionally under the influence of a vibrator, flows vertically downward and also spreads laterally outward into the channels 13. The vertical slots 12 and bores 14 provide unhindered and complete exhaustion of the displaced air. When all air has been displaced and exhausted, the vertical slots 12 and bores 14 act as vertical conduits or risers and also fill up with concrete. This has the particular advantage of permitting an intimate interconnection between adjacent narrow ends of the blocks 1.

A further advantage of the invention is that the flow-communicating system composed of the vertical apertures 11 and the vertical slots 12 and bores 14 and the longitudinal channels 13 after the pouring operation causes the formation of a concrete grill or network of very high strength. Additionally, the vertical apertures 11 and the longitudinal channels 13 are well suited for accommodating reinforcing members for the concrete or utility conduits or both before the concrete is poured.

It can be further be seen from FIG. 2 that an accurately plumb and rapid erection of a wall using the hollow-core construction blocks 1 of the invention is considerably facilitated by the employment of the positioning or locating pins or dowels 15. Normally three pins 15 are employed in each joint. These locating pins or dowels 15 can be be made of cement, plastic or similar material and can be conically drafted. A transverse wire or rod 15' can serve as a limit stop for the installation depth.

As can be further construed from FIG. 2, the hollow-core construction blocks 1 of the invention also permit the ready connection of transverse abutting walls as corner connections, T-connections or cross connections in which the half-slots 12', 14' in the narrow ends of the hollow-core construction blocks 1 permit a concreted connection. Such connections can be further improved by laying the hollow-core construction blocks of the abutting walls with alternating gaps to form an interleaving or dovetailed connection.

Figure 3:
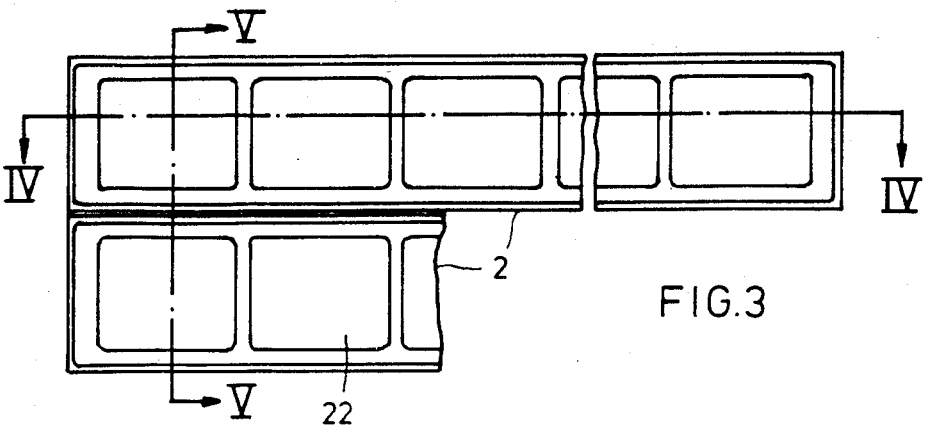
FIG. 3 shows a schematic plan view of parts of two structural floor members according to the invention.
Figure 4:
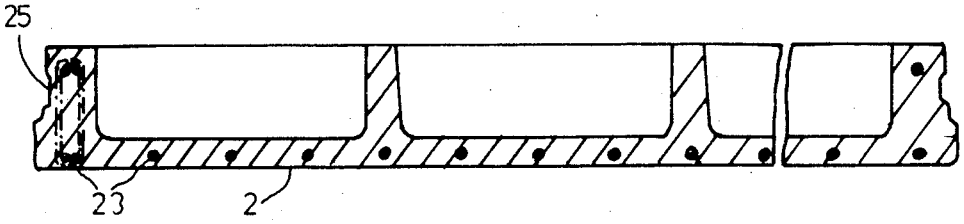
FIG. 4 is a schematic longitudinal section taken along the line IV—IV in FIG. 3.

The cellular structural floor members 2 described above can be employed for any desired floor or roof structures. The cellular structural floor members 2 have a predetermined width and a predetermined free span length and are preferably and substantially uniformly made of the same material as the previously described hollow-core construction blocks 1. The configuration of the cellular structural floor members 2 as well as their use in the structure can best be seen in FIGS. 3 and 5.

In order to be able to fulfill the strictest structural requirements with these cellular structural floor members 2, they are provided with a substantially U-shaped or channel cross section and in longitudinal section, they are formed by adjacent substantially U-shaped cells or structural fields 22 and are furthermore provided with a reinforcing armature 23.

Figure 5:
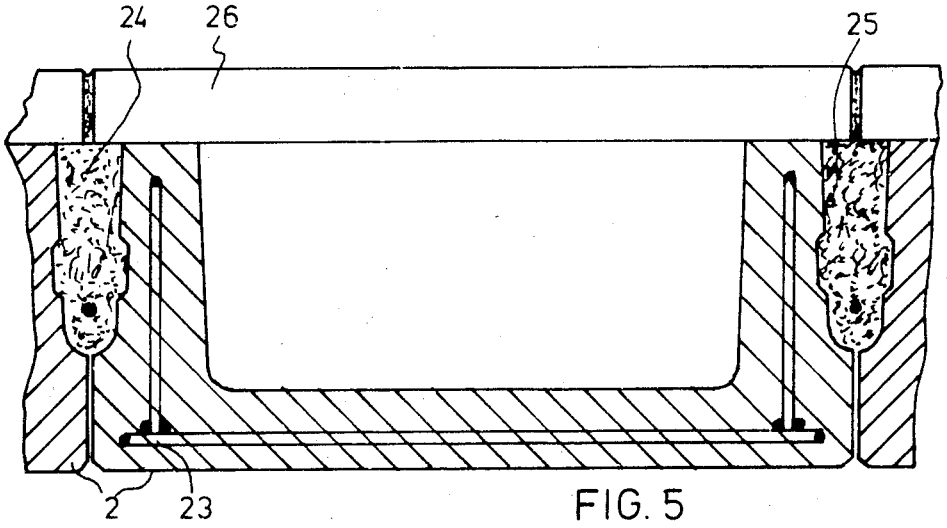
FIG. 5 is schematic cross section taken along the line V—V in FIG. 3.

The cellular structural floor members 2 are provided at their outer edges with recesses or steps 25 which cooperate with further such recesses 25 in adjacent floor members 2 to form reservations or channels 24 for the effective connection of the cellular structural floor members to one another and to the support structure 1', as best can be seen in FIG. 5.

As already mentioned above, the cells or basin-shaped structural fields 22 of the cellular structural floor members 2 are covered at their open tops with suitable floor panel elements 26.

It will be understood that the cellular structural floor members 2 are also suited to the accommodation of various electrical and sanitary installations.

The measures and arrangements described above therefore produce a modular construction system for the erection of buildings which satisfies all modern technical and economical requirements.

While there are shown and described present preferred embodiments of the invention, it is to be distinctly understood that the invention is not limited thereto, but may be otherwise variously embodied and practiced within the scope of the following claims.

Accordingly, what I claim is:

1. A modular construction system for the erection of buildings, comprising:

at least one hollow-core construction block structured to be mutually superposed with other such blocks without intervening mortar;

said at least one block being substantially quadrangular rectangular and including at least two substantially round, vertical through apertures arranged in predetermined spaced relationship in a direction extending longitudinally of the block;

said at least one block being provided with substantially vertical slots arranged in predetermined spaced relationship in a direction extending longitudinally of the block;

said vertical apertures being arranged in adjacent relationship to said substantially vertical slots;

said substantially vertical apertures and said vertical slots opening at a common set of ends thereof in said block into a longitudinal channel fashioned in said block to have an at least approximately semicircular cross-section;

a predetermined number of said hollow-core construction blocks, when assembled to form a predetermined wall structure, conjointly forming a flow-communicating system by means of said vertical apertures, said vertical slots and said longitudinal channels; and said flow-communicating system essentially extending in two mutually perpendicular directions through substantially the entire wall structure assembled from said hollow-core construction blocks and at least receiving a pourable, curable building material forming in its cured state a high-strength network vertically and horizontally extending through and thereby interconnecting said predetermined number of hollow-core construction blocks assembled to form said predetermined wall structure.

2. The modular construction system as defined in claim 1, wherein:

said longitudinal channels are fashioned in an upper side of said at least one block.

3. The modular construction system as defined in claim 1, wherein:

said longitudinal channels are fashioned in a lower side of said at least one block.

4. The modular construction system as defined in claim 1, wherein:

said vertical slots are structured to have vertical bores at their ends for accommodating positioning means.

5. The modular construction system as defined in claim 1, wherein:

each said block includes four of said substantially vertical apertures;

each of said four substantially vertical apertures being arranged in adjacent relationship to one of said vertical slots at each of its sides relative to the longitudinal direction of the block; and at least one of said vertical slots being disposed at a lateral end of the block and structured as a partial slot open on one of its sides at said lateral end of the block for cooperating with a corresponding such partial slot on an adjacent such block to form therewith a fully surrounded substantially vertical slot.

6. The modular construction system as defined in claim 1, further including:

at least one cellular structural floor member supported by a bearing lintel member incorporated into walls formed of said blocks.

7. The modular construction system as defined in claim 1, further including:

at least one cellular structural floor member having a predetermined width and a predetermined free span length which is supported at its narrow end by walls formed of said construction blocks in an erected building; and panel elements for covering said narrow ends of said cellular structural floor members supported in said walls.

8. The modular construction system as defined in claim 1, wherein:

at least the construction blocks and the cellular structural floor members are substantially uniformly made of a light weight construction material.

9. The modular construction system as described in claim 1, wherein:

said at least one construction block and said at least one cellular structural floor member are substantially uniformly made of light weight concrete.

10. The modular construction system as described in claim 1, wherein:

said at least one construction block and said at least one cellular structural floor member are substantially uniformly made of wood wool concrete.

11. The modular construction system as defined in claim 1, further including:

at least one cellular structural floor member having a predetermined width and a predetermined free span length and which is supported at its narrow end by walls formed of said construction blocks in an erected building.

12. The modular construction system as defined in claim 11, wherein:

said at least one cellular structural floor member has a substantially channel-shaped cross section and a longitudinal section comprising channel-shaped cells and is provided with reinforcing means.

13. The modular construction system as defined in claim 11, wherein:

said at least one cellular structural floor member is provided with at least one reservation at least at one of its outer edges for cooperating with a corresponding such reservation in an adjacent such cellular structural floor member to form a channel capable of being filled with fluid concrete.

14. The modular construction system as defined in claim 11, wherein:

said at least one cellular structural floor member has a substantially channel-shaped cross section and a longitudinal section comprising channel-shaped cells and is provided with reinforcing means; and at least one of said channel-shaped cells of said cellular structural floor member is covered by at least one floor panel member.

15. A method of erecting buildings and comprising the steps of:

superposing a predetermined number of hollow-core construction blocks, which contain substantially vertical apertures, substantially vertical slots and a substantially horizontal longitudinal channel interconnecting said substantially vertical apertures and said substantially vertical slots on one side of each one of said predetermined number of hollow-core construction blocks, without intervening mortar between said hollow-core construction blocks;

said step of superposing said predetermined number of said hollow-core construction blocks entails the steps of assembling a predetermined wall structure from said superposed hollow-core construction blocks and forming by said substantially vertical apertures, said substantially vertical slots and said substantially horizontal longitudinal channels of said superposed hollow-core construction blocks a flow-communicating system essentially extending in two mutually perpendicular directions through said assembled predetermined wall structure;

pouring a pourable and curable building material into said substantially vertical apertures of said hollow-core construction blocks at the top of said assembled predetermined wall structure;

filling said substantially vertical apertures of said flow-communicating system from the top with said curable building material;

during said step of filling said flow-communicating system, exhausting air which is present in the flow-communicating system, through said substantially vertical slots and filling said substantially vertical slots and said substantially horizontal longitudinal channels with said curable building material; and curing said pourable and curable building material filling said flow-communicating system and thereby forming a high-strength network extending through and interconnecting said predetermined number of superposed hollow-core construction blocks assembled to form said predetermined wall structure.

16. The method as defined in claim 15, further including the steps of:

preparing a substantially uniform, cellular structural floor member having a predetermined width and a predetermined free span length;

during said step of superposing said predetermined number of hollow-core construction blocks to form said assembled predetermined wall structure, incorporating a bearing lintel member into the assembled predetermined wall structure; and supporting said substantially uniform, cellular structural floor member at said lintel member incorporated in said assembled predetermined wall structure.

17. The method as defined in claim 16, further including the steps of:

providing substantially vertical bores at the ends of said substantially vertical slots in said hollow-core construction blocks; and during said step of superposing said predetermined number of hollow-core construction blocks, inserting positioning means into a preselected number of said vertical bores in said superposed hollow-core construction blocks.

18. The method as defined in claim 16, further including the step of:

pre-fabricating said hollow-core construction blocks and providing complementary partial configurations of said substantially vertical slots at each lateral end of said hollow-core construction blocks.

19. The method as defined in claim 18, wherein:

said step of pre-fabricating said hollow-core construction blocks entails selecting said pourable and curable light-weight construction material from the group essentially consisting of light-weight concrete and wood wool concrete and pre-fabricating said hollow-core construction blocks such as to be substantially uniformly made of said selected light-weight construction material.

* * * * *